US006964258B2

(12) United States Patent
Gudgeon et al.

(10) Patent No.: US 6,964,258 B2
(45) Date of Patent: Nov. 15, 2005

(54) ENGINE REVOLUTION LIMITER

(75) Inventors: Joseph A. Gudgeon, La Farge, WI (US); Nevin R. Hillegass, Richland Center, WI (US); Brian S. Lindell, North Mankato, MN (US)

(73) Assignee: S & S Cycle, Incorporated, Viola, WI (US)

( * ) Notice: Subject to any disclaimer, the term of this patent is extended or adjusted under 35 U.S.C. 154(b) by 116 days.

(21) Appl. No.: 10/698,841

(22) Filed: Oct. 31, 2003

(65) Prior Publication Data

US 2005/0092290 A1 May 5, 2005

(51) Int. Cl.[7] ..... F02P 11/02; F02D 31/00
(52) U.S. Cl. ..... 123/335; 123/198 D
(58) Field of Search ..... 123/198 D, 198 DC, 123/333, 335; 701/110, 112

(56) References Cited

U.S. PATENT DOCUMENTS

| | | | | |
|---|---|---|---|---|
| 4,067,303 A | | 1/1978 | Aoki et al. | 123/339.29 |
| 4,375,207 A | * | 3/1983 | Sieber et al. | 123/333 |
| 5,803,043 A | | 9/1998 | Bayron et al. | 123/335 |
| 5,943,997 A | | 8/1999 | Kinsey et al. | 123/516 |
| 6,044,822 A | | 4/2000 | Daniels | 123/196 R |
| 6,445,985 B1 | | 9/2002 | Bitzer et al. | 701/35 |
| 6,474,300 B1 | * | 11/2002 | Steffen | 123/198 D |
| 6,499,341 B1 | | 12/2002 | Lodise et al. | 73/117.3 |
| 6,541,959 B2 | | 4/2003 | Gudgeon et al. | 324/207.15 |
| 6,557,510 B2 | | 5/2003 | Sjovall et al. | 123/182.1 |
| 6,560,528 B1 | | 5/2003 | Gitlin et al. | 701/115 |
| 6,588,259 B2 | | 7/2003 | Lodise et al. | 73/117.3 |

OTHER PUBLICATIONS

S&S Cycle Catalog No. 13, Power Kits, pp 2–1 through 2–7, Feb. 2002.*

* cited by examiner

*Primary Examiner*—Tony M. Argenbright
(74) *Attorney, Agent, or Firm*—Heller Ehrman White and McAuliffe LLP

(57) ABSTRACT

An engine revolution limiter system is utilized to limit engine speed during a break-in period. The system provides for programming a variable break-in period and a variable selectable engine revolution limit. During the break-in period, if the revolution limit is exceeded by the engine speed, firing of the ignition is limited. In addition, the system provides for an over revolution limit wherein the ignition stops firing if the over revolution limit is exceeded. In addition, multiple break-in periods may be programmed with different associated revolution limits and over revolution limits. This provides for gradually increasing the allowable engine speed as the engine has been operating for greater periods of time.

22 Claims, 6 Drawing Sheets

ENGINE REVOLUTION LIMITER

BACKGROUND OF THE INVENTION

1. Field of the Invention

The present invention relates to an internal combustion engine revolution limiting apparatus, and in particular to a system and method for limiting maximum engine revolutions during a break-in period.

2. Description of the Prior Art

It is often recommended with internal combustion engines to limit the engine operating speed during an initial break-in period. Limiting the operating speed places less stress on the engine initially and allows components to seat relative to one another. Engine components operate without undue stress that might otherwise damage some of the components.

In the past, such limiting of engine speed was accomplished by simply informing operators that the engine should be operated at or below certain engine speed limits for specified initial time periods. However, an owner of a new vehicle often wants to test its speed and acceleration. The recommendations are ignored and damage to the engine may occur.

Devices and systems have been utilized that limit the engine operating speed during an initial break-in period and at other times when engine operating speed should be limited. For some applications, as the break-in period proceeds, it is desirable to increase the engine speed limit. Existing devices that limit revolutions during break-in do not provide for increasing the revolution limit.

Devices have been developed that provide for revolution limiting during a break-in period. U.S. Pat. No. 4,067,303 to Aoki shows a fuel injection pump governor. Although the device provides for limiting engine RPMs during a break-in period, the system uses a spring type governor that is mechanically actuated. The device must be manually reset after the break-in period. U.S. Pat. No. 6,044,822 to Daniels shows a programmed break-in mode in a two cycle engine. The Daniels patent teaches only control of an oil pump at two modes in a two cycle engine and does not provide variability and utilization with multiple different engines or multiple settings.

It can be seen that a new system and method for limiting engine speed during a break-in period is needed. Such a system should provide for variability of the break-in period and the engine limits. Moreover, the revolution limiting should utilize methods that provide for safe operation of the vehicle if the limit is reached during the break-in period. Multiple different time break-in periods and maximum engine speeds should be possible for gradual break-in. The present invention addresses these problems, as well as others associated with limiting engine speed during a break-in period.

SUMMARY OF THE INVENTION

The present invention is directed to an engine control system and in particular to an engine control system that limits engine speed during a break-in period. The engine control system provides for limiting or stopping firing of the ignition if selectable engine speed levels are exceeded during an initial, selectable break-in period. For example, during an initial eight hour break-in period, if an engine speed exceeds 4,000 RPM, ignition firing is limited. The control system provides for selecting one or more break in periods and associated engine speed limits. In addition, an over-revolution limit, which is greater than the revolution limit may also be selected wherein further engine controls are implemented.

The control system is programmed by setting an initial break-in period and an associated engine maximum speed level. In addition, an over-revolution speed level may also be selected that is higher than the maximum speed level in case of emergencies wherein limiting engine speed by limiting firing of the ignition is not sufficient. In addition to selecting an initial break-in period, multiple time periods with associated engine limits and over-revolution limits may also be preset and programmed into the control system. For example, an initial break-in period may last for eight hours with a first maximum engine speed of 4,000 RPM. However, a second period extending through sixteen hours of engine operating time may raise the limit to 5,000 RPM. It can be appreciated that any number of break-in periods and associated engine speeds may be utilized with the present system, as explained hereinafter. Such a system provides for allowing the engine speed to be increased as additional hours of operation allow for increasing stress on the engine as the likelihood of damage from the increased speed diminishes. When all of the preset operating break-in periods have expired, the engine is in normal operation mode with no revolution limits, or a normal operational rev limit that remains during all further engine operation.

In operation, when the engine has been started, a run-time monitor compares the accumulated engine run time to the predetermined break-in period. If the break-in period has not been exceeded, engine speed is compared to the associated revolution limit. This monitoring is continuous until the break-in period is completed. If the engine speed exceeds the revolution limit, ignition firing is limited. In a preferred embodiment, a "stuttering" type ignition firing method is used. Such a stuttering firing sequence may be firing the spark plugs twice in their normal sequence, then preventing them from firing twice from the normal sequence, or "missing," in alternating steps. Other stuttering firing sequences that skip firings may also be utilized. This has advantages over methods that simply stop firing the ignition. The engine still has power, but with stuttering, tends to slow down from the limited firing of the ignition. The stuttering type engine firing continues as long as the engine speed is above the revolution limit. When the engine speed has gone below the revolution limit, normal continuous firing resumes.

In addition, the revolution limiter system may be modified so that the controller has an over-revolution limit that is greater than the revolution limit. A typical over-revolution limit might be approximately 256 RPM higher than the associated revolution limit. If the system's engine speed monitor determines that the revolution limit has been exceeded, it compares engine speed to the over-revolution limit, to determine whether it has been exceeded. If the over-revolution limit is exceeded, the firing to the ignition stops altogether until it is determined by the engine speed monitor that the engine speed is below the over-revolution limit. It can be appreciated that in some circumstances such as a vehicle going down hill, that limiting ignition firing may not slow down the engine sufficiently and engine speed may remain at an increased level. Therefore, the additional over-revolution limit is added. The system has advantages in that the engine operator will notice when the revolution limit is exceeded by the stuttering noise of the engine and will usually make manual adjustments to lower engine speed. This also provides for power from the engine for longer periods, giving the operator better control. However, if the revolution limiting is not sufficient to slow the engine, then the ignition firing stops. It is foreseen that if the operator is correctly operating the engine, the over-revolution limit should rarely be exceeded as the operator may manually limit operating speed once stuttering is detected.

It can also be appreciated that multiple break-in periods may be programmed. In operation, if the system's operating time monitor determines that an initial break-in period has expired, the monitor then determines whether there are two or more break-in periods. If the first break-in period has expired, but still other break-in periods have not expired, the associated revolution limit for the second and succeeding break-in periods will be compared to the engine speed. The additional break-in periods may also have associated over-revolution limits. With multiple break-in periods, the revolution limit is gradually increased as more operating time passes. When the monitoring system determines that all break-in periods have expired, the revolution limits are removed and the engine operates in a normal mode, which may or may not have a rev limit.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings wherein like reference numerals and letters indicate corresponding structure throughout the several views.

DETAILED DESCRIPTION OF THE PREFERRED EMBODIMENT

Figure 1:
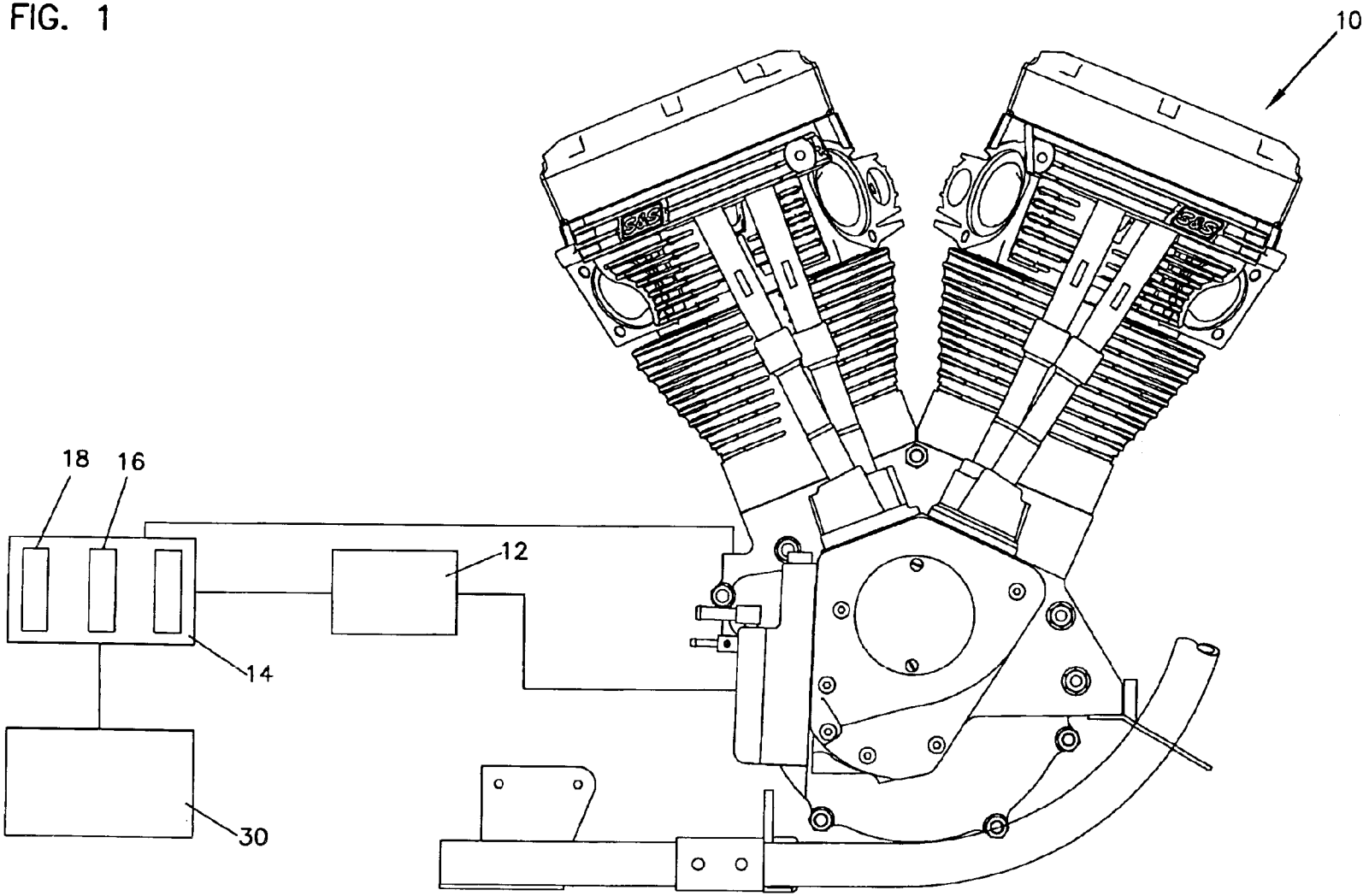
FIG. 1 shows a diagrammatic view of a motorcycle engine and engine revolution limiting system according to the principles of the present invention.

Referring now to the drawings and in particular to FIG. 1, there is shown an internal combustion engine, generally designated 10. The engine 10 generally includes cylinder assemblies and a crankcase providing power through a drive shaft. An ignition 12 provides spark to fire the spark plugs of the cylinder assemblies. The present invention is adaptable to all types of internal combustion engines including two cycle, four cycle and diesel engines. Moreover, the present invention is not limited to engines having a particular number of cylinders. A revolution limiter system 14 acts as an ignition control and includes a speed monitor 16 as well as an engine run time monitor 18. The engine speed monitor 16 and the run time monitor 18 measure engine speed and running time by any of several systems and methods well known in the art. A reset 30 allows the engine control system 14 to be reset or reprogrammed. In addition, the limits and various parameters may be changed by inputs from the reset 30. The reset 30 may be in the form of a laptop computer or other control interface that easily accesses and interfaces with the processor of the ignition control system 14. The ignition control 14 may be original equipment and preprogrammed or may be added as an aftermarket item.

Figure 6:
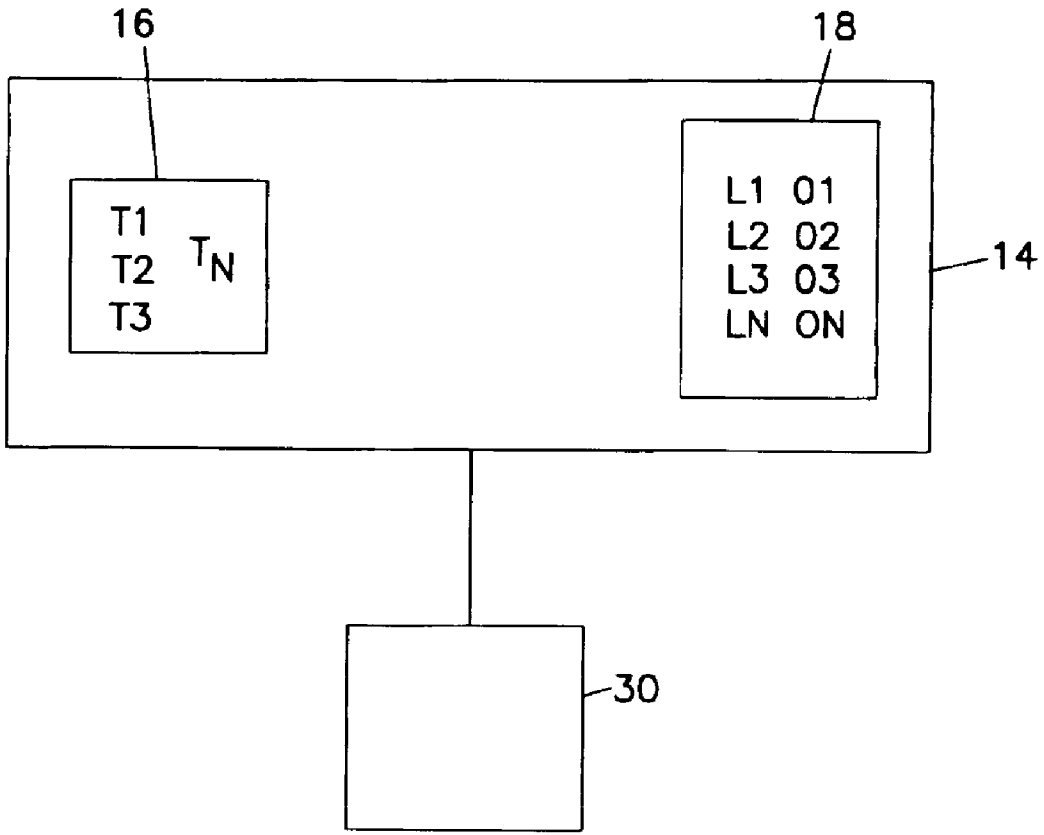
FIG. 6 shows a diagrammatic view of the input for the engine revolution limiting system shown in FIG. 1.

Referring now to FIG. 6, the engine monitoring system 14 and reset 30 are shown for the initial setup to limit engine speed during a break-in period. The control system 14 is programmable so that a variable predetermined break-in period may be set. For example, a break-in period of eight hours may be input. In addition, a corresponding speed limit is also input, with a typical limit being 4224 RPMs. Ignition firing is limited above this threshold. As explained hereinafter, it is also possible that the system might utilize an over-revolution limit, which is greater than the revolution limit, wherein the system stops firing the ignition, as explained hereinafter. A typical over-revolution engine speed limit is 256 RPMs greater than the engine speed limit.

In addition, the present system also provides for inputting multiple break-in periods, each having an associated engine speed limit. For example, an initial break-in period of eight hours may be input with an associated engine maximum revolution limit of 4224 RPMs. This is represented by T1 and L1 in FIG. 6. An over-revolution limit, which may be 256 RPMs greater than the revolution limit for example, may also be utilized, as represented by O1. A second break-in period as represented by T2, may also be input that typically has a break-in engine speed limit greater than the initial break-in period. A typical setting might be 16 hours for T2 with a maximum engine speed of 5120 RPMs as represented by L2. It is also foreseen that an over revolution limit O2 greater than the engine speed limit L2 may be utilized. A third break-in period T3 having a corresponding break-in speed limit L3 and an over-revolution speed limit O3 may also be programmed. Typical settings would be a break-in period of 24 hours, a speed limit of 6016 RPMs and an over revolution limit 256 RPMs greater than the engine speed limit. The present invention provides for even more predetermined, preset revolution break-in periods and engine revolution limit settings and over-revolution limit settings as represented by TN, LN and ON. The control system 14 monitors the various input parameters and continues automatically monitoring and comparing the engine revolution limit to control engine speed, as explained hereinafter.

Figure 2:
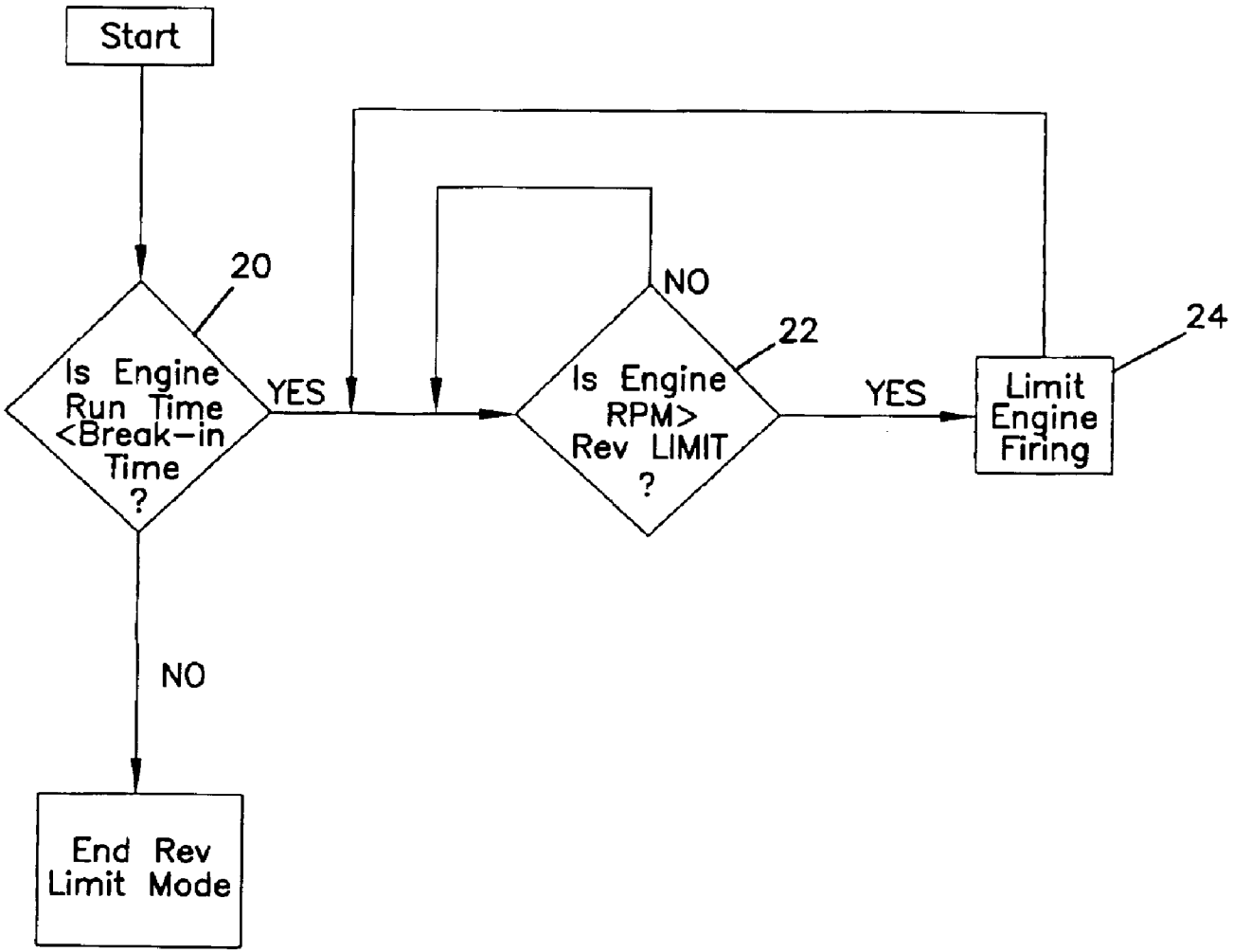
FIG. 2 shows a flow chart of a first embodiment of the engine revolution limiting system shown in FIG. 1.

Referring now to FIGS. 1 and 2, there is shown a first embodiment of the control system 14. Upon startup, the engine control system utilizes the time monitor 18 to determine whether the engine operating time is less than the predetermined break-in period at step 20 of FIG. 2. If the operating time is less than the break-in period, then the engine speed monitor 16 checks to measure engine speed at step 22. If the engine speed is greater than the preset revolution limit, firing of the ignition is limited as at step 24. The engine speed is continually monitored as at step 22. Limiting of the firing of the ignition at step 24 has the effect of slowing down the engine speed so that it is anticipated that engine speed will fall back below the predetermined limit quickly in most operating conditions.

In a preferred embodiment, once the revolution limit is exceeded and firing of the ignition is limited as at step 24, a particular firing sequence is engaged. In one embodiment, the engine ignition is fired twice as in a normal sequence and then the ignition skips two firings, or misses twice, as compared to the normal sequence when the revolution limiter detects that the over-revolution limit has been exceeded. In this mode, the engine will make a "stuttering" sound that is easily recognized and alerts the operator that the engine 10 is in a limiting mode and that the break-in revolution limit has been exceeded. Other stuttering firing sequences wherein the ignition skips firing in predetermined patterns may also be utilized. Engines having greater numbers of cylinders, such as 4, 6 or 8, may require particular stuttering firing sequences to reduce engine speed and power without damaging the engine. Such a firing sequence provides advantages over systems wherein the ignition is simply turned off. As the ignition fires spark plugs and then skips firing them in an alternating fashion, the engine continues to have power, although less power than in normal operating mode. In systems wherein the ignition is simply stopped once the engine revolution limit has been exceeded, the spark is simply turned off. The operator enjoys improved control and continued power with the present system while still achieving the advantages of limiting engine speed during the break-in period.

Figure 3:
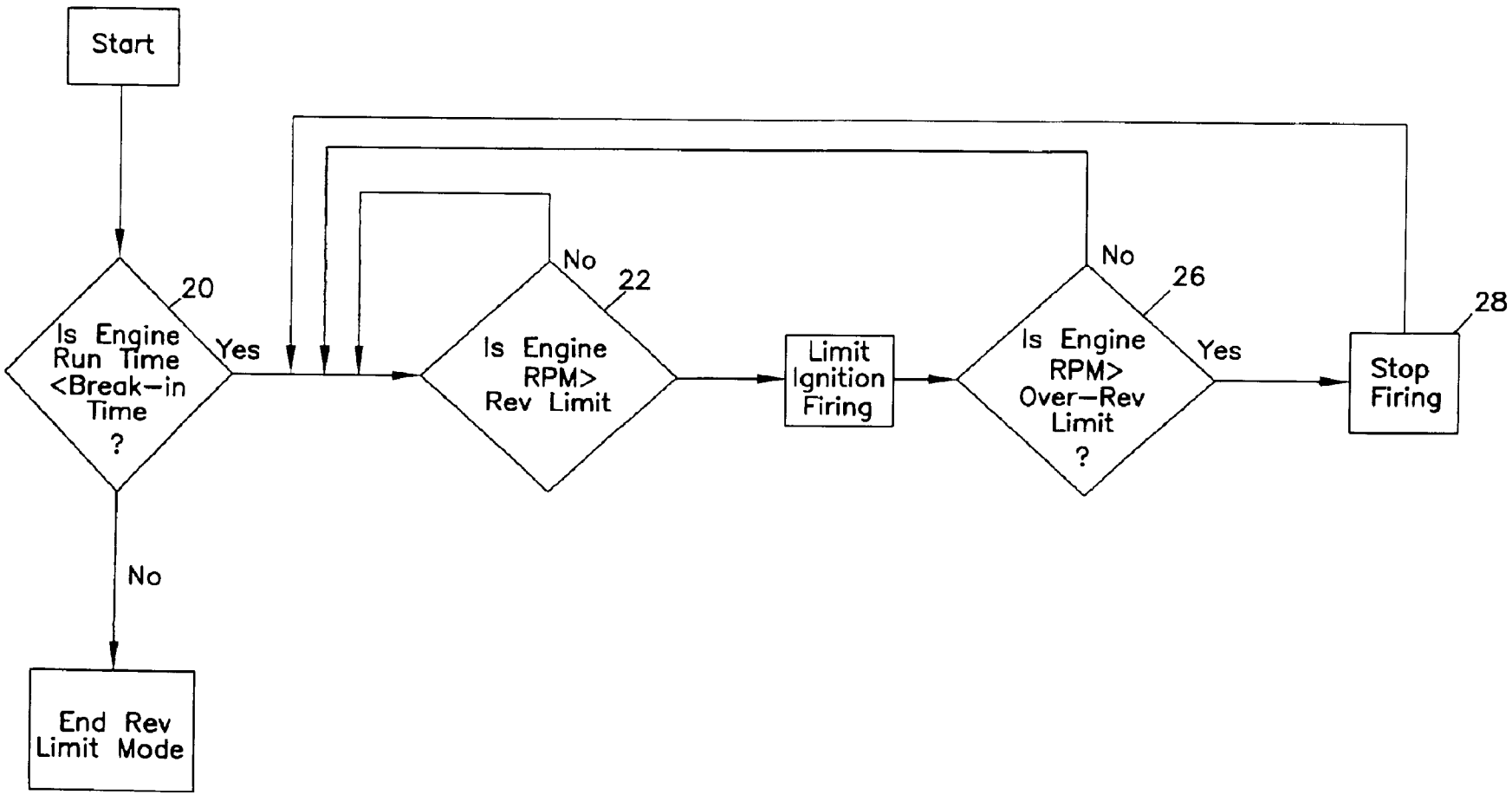
FIG. 3 shows a flow chart of a second embodiment of the engine revolution limiting system shown in FIG. 1.

Referring now to FIG. 3, there is shown a second embodiment of the revolution limiter control system. The second embodiment of the revolution limiter control system works in a similar manner to the embodiment shown in FIG. 2, but includes additional steps 26 and 28. As with the embodiment shown in FIG. 2, if it is determined that the run time is less than the break-in time and that the revolution limit has been exceeded, firing of the ignition is limited as shown in step 24. In addition, as shown in step 26, the speed monitor 16 also compares engine speed to an over-revolution limit, to determine whether it has been exceeded. If so, the control system 14 stops the ignition 12 from firing to the spark plugs, as shown in step 28. The initial break-in period at step 20, the associated revolution limit of step 22, and the associated over-revolution limit of step 26 are represented in FIG. 6 by variables T1, L1 and O1 respectively. It can be appreciated that stopping the firing as at step 28 has the effect of drastically slowing the engine. However, such measures may be necessary in conditions wherein the engine speed is increased due to a vehicle rolling downhill for example, and not slowing down even with the limiting of ignition firing at step 24. Completely stopping the firing to the ignition has even a greater effect to slow the engine speed down. Although prior systems may stop firing to the ignition, they do not give warning of the revolution limit being reached. The present invention provides for stuttering of the engine after the firing of the engine is limited at step 24. Therefore, the operator is given an audible warning that the rev limit has been exceeded and if engine speed continues to increase, the over-revolution limit may also be exceeded. The operator has the opportunity to manually limit the engine speed without the revolution limiter system 14 switching to a stop firing mode. This method provides for continued power, although reduced, with greater operator control and less likelihood of an over-revolution limit being exceeded.

Figure 4:
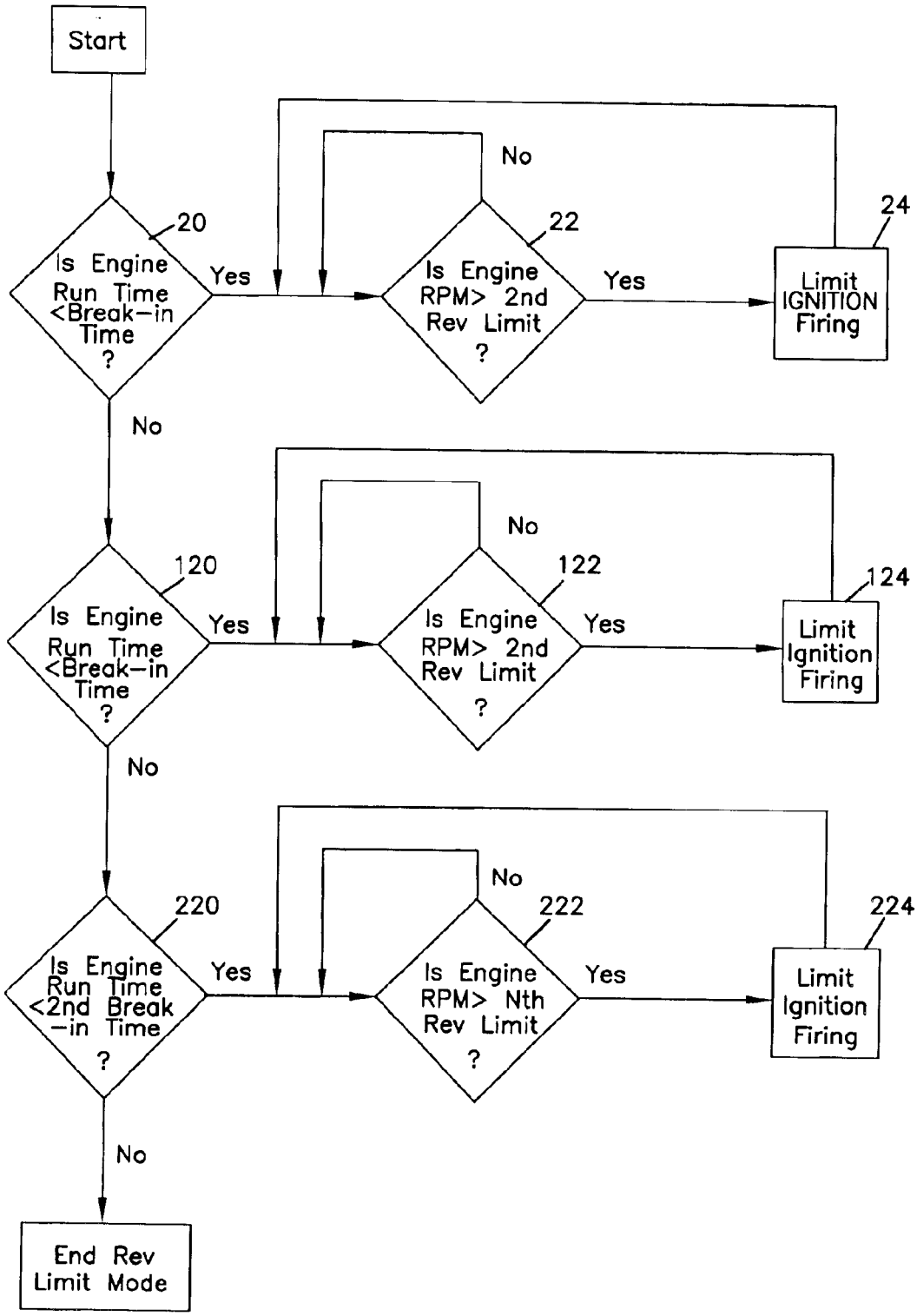
FIG. 4 shows a flow chart of a third embodiment of the engine revolution limiting system shown in FIG. 1.

Referring to FIG. 4, there is shown a third embodiment of the present invention. As in FIG. 2, the engine run time is monitored at step 20, the engine speed is monitored at step 22 and ignition firing is limited at step 24. However, multiple break-in periods and corresponding engine revolution limits are programmed, and additional monitoring takes place at steps 120 and 122. For example, if a second break-in period T2 has been programmed at step 120, the period will be monitored after an initial break-in period expires. If the corresponding engine revolution limit, as represented by L2, has been exceeded, as detected by monitoring at step 122 in FIG. 4, engine ignition firing is limited at step 124 and stuttering occurs.

If the first and second break-in periods have expired, the control system 14 checks to see whether a third break-in period, or additional periods as represented by TN, have been set. If the engine run time is less than the break-in period TN, the monitoring system 14 compares engine speed to the corresponding revolution limit as represented at 222. If it has been exceeded, firing of the ignition is limited as shown at step 224. Although three break-in periods and corresponding revolution limits are shown in FIG. 4, it can be appreciated that greater numbers of periods may also be programmed according to the principles of the present invention, providing for gradually increasing the limit in very small increments.

Figure 5:
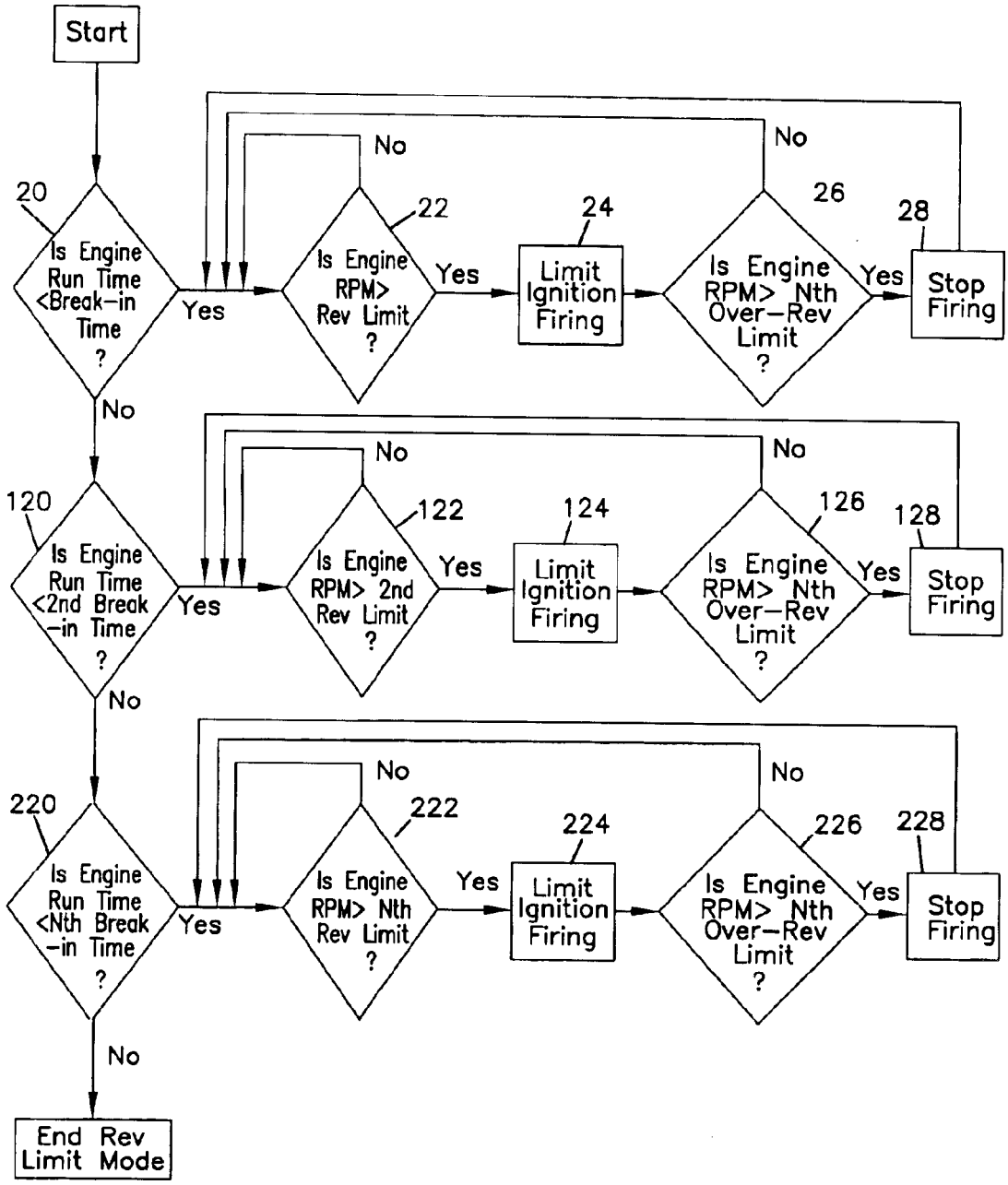
FIG. 5 shows a flow chart of a fourth embodiment of the engine revolution limiting system shown in FIG. 1.

Referring to FIG. 5, there is shown a further embodiment of the engine control system. The embodiment of the control system shown in FIG. 5 shares aspects of embodiments shown in FIGS. 3 and 4. As in FIG. 3, the initial break-in period T1 is monitored at step 20, the corresponding initial engine revolution limit L1 is monitored at step 22. If the engine revolution limit is exceeded, firing of the ignition is limited at step 24 and the over-revolution limit O1 is compared to engine speed at step 26. If the over-rev limit is reached, firing of the ignition is stopped at step 28.

In addition, in a manner similar to FIG. 4, the multiple break-in periods with associated engine rev limits and over-rev limits are also envisioned with the present invention. In a manner similar to FIG. 4, at start up, if the engine run time is less than the break-in period T2 as shown in step 120 of FIG. 5, the associated revolution limit T2 of FIG. 6 is monitored at step 122. If the engine speed is greater than the revolution limit T2, limiting of firing to the ignition takes place at step 126. In addition, the second over-revolution limit O2 is compared to the engine speed, and if exceeded, ignition firing is stopped.

If the engine run time is greater than the second time limit T2, the control system 14 checks for a third break-in period T3 as represented by step 220. If the engine ruin time is less than the break-in period, the engine ignition may be limited if the rev limit is exceeded, as at step 224. The monitoring system 14 then compares the engine speed to the over revolution limit O3 at 226 and, if the over revolution limit is exceeded, firing by the ignition is stopped at step 228. Such monitoring continues through the last of the programmed break-in periods, represented by TN and the corresponding revolution limits LN and over revolution limits ON. When the final break-in period TN has expired, the engine control system disengages and allows the engine to operate in normal operating mode. In normal operating mode, there may be no speed limits on the engine or an ongoing rev limit, depending on the engine and the application. However, should there be a need to reset the revolutions limits, such as may occur if the engine is rebuilt for example, new break-in periods and corresponding engine rev limits and over-revolution limits may be re-input, as shown in FIG. 6. The present invention provides for improved control with multiple break-in periods and multiple break-in revolution limits. Moreover, the present invention provides for improved methods of controlling engine speed with a stuttering warning mode and an over revolution limit that shuts off firing of the ignition at an increased threshold.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A system for limiting engine speed comprising:

an engine speed monitor;

an operation monitor for tracking engine operating time; and a limiter for limiting engine speed when the monitor determines that a first predetermined speed has been exceeded before a first predetermined engine operating time has expired, wherein the limiter includes a plurality of predetermined speeds and associated engine operating times.

2. A system for limiting engine speed comprising:

an engine speed monitor;

an operation monitor for tracking engine operating time; and a limiter for limiting engine speed when the monitor determines that a first predetermined speed has been exceeded before a first predetermined engine operating time has expired, wherein the limiter stops firing the spark plugs while the engine speed is above a second predetermined speed greater than the first predetermined speed.

3. A system for limiting engine speed comprising:

an engine speed monitor;

an operation monitor for tracking engine operating time; and a limiter for limiting engine speed when the monitor determines that a first predetermined speed has been exceeded before a first predetermined engine operating time has expired, wherein the limiter limits engine speed when the monitor determines that a second predetermined speed has been exceeded before a second predetermined operating time has been met.

4. A system according to claim 3, wherein the limiter limits engine speed when the monitor determines that a third predetermined speed has been exceeded before a third predetermined operating time has been met.

5. A system according to claim 3, wherein the limiter places the engine in a stuttering mode while the engine speed is above the first predetermined speed.

6. A system for limiting engine speed, comprising:

an engine speed monitor;

an operation monitor for tracking engine operating time; and a limiter for limiting engine speed when the monitor determines that a first predetermined speed has been exceeded before a first predetermined engine operating time has expired, wherein the limiter places the engine in a stuttering mode while the engine speed is above the first predetermined speed; and wherein the limiter stops firing the spark plugs while the engine speed is above a second predetermined speed greater than the first predetermined speed.

7. A system according to claim 6, wherein the limiter stops firing the spark plugs twice and fires twice while the engine speed is above the first predetermined speed.

8. A method of limiting maximum engine speed, comprising:

monitoring engine speed;

tracking engine operating time;

detecting when engine speed exceeds a predetermined first speed before an associated first predetermined engine operating time has expired; and limiting engine speed while the first speed is exceeded, wherein a plurality of predetermined speeds are detected for a plurality of associated engine operating times.

9. A method according to claim 8, wherein limiting engine speed comprises stuttering the ignition firing while the engine speed is above the first speed.

10. A method according to claim 9, wherein limiting engine speed comprises stopping ignition firing while the engine speed is above a second predetermined speed greater than the first speed.

11. A method according to claim 8, wherein limiting engine speed comprises limiting engine speed when the monitoring determines that a second predetermined speed has been exceeded before a second predetermined operating time has expired.

12. A method according to claim 11, wherein limiting engine speed comprises limiting engine speed when the monitoring determines that a third predetermined speed has been exceeded before a third predetermined operating time has expired.

13. A method according to claim 11, wherein while the engine speed is above the second predetermined speed, the limiting engine speed comprises alternating modes of:

stopping the ignition from firing twice, and firing the ignition twice.

14. A method according to claim 8, wherein limiting engine speed comprises stopping ignition firing twice and firing the ignition twice while the engine speed is above the first speed.

15. A method according to claim 9, wherein limiting engine speed comprises stopping ignition firing while the engine speed is above a second predetermined speed greater than the first speed.

16. An internal combustion engine, comprising:

one or more cylinders;

an ignition firing to spark plugs;

an engine speed monitor;

an operation monitor for tracking engine operating time; and a limiter for limiting engine speed when the monitor determines that a first predetermined speed has been exceeded before a first predetermined engine operating time has expired, wherein the limiter includes a plurality of predetermined speeds and associated engine operating times.

17. An engine according to claim 16, wherein the limiter stutters the engine while the engine speed is above the first predetermined speed.

18. An engine according to claim 17, wherein the limiter stops firing to the spark plugs twice and fires twice while the engine speed is above the first predetermined speed.

19. An engine according to claim 17, wherein the limiter stops firing the spark plugs twice and fires twice while the engine speed is above the second predetermined speed.

20. An internal combustion engine, comprising:

one or more cylinders;

an ignition firing to spark plugs;

an engine speed monitor;

an operation monitor for tracking engine operating time; and a limiter for limiting engine speed when the monitor determines that a first predetermined speed has been exceeded before a first predetermined engine operating time has expired, wherein the limiter stops firing to the spark plugs while the engine speed is above a second predetermined speed greater than the first engine speed.

21. An internal combustion engine, comprising:

one or more cylinders;

an ignition firings to spark plugs;

an engine speed monitor;

an operation monitor for tracking engine operating time; and a limiter for limiting engine speed when the monitor determines that a first predetermined speed has been exceeded before a first predetermined engine operating time has expired, wherein the limiter limits engine speed when the monitor determines that a second predetermined speed has been exceeded before a second predetermined operating time has been met.

22. An engine according to claim 21, wherein the limiter limits engine speed when the monitor determines that a third predetermined speed has been exceeded before a third predetermined operating time has been met.

* * * * *